United States Patent [19]

Friedman

[11] 3,988,746

[45] Oct. 26, 1976

[54] PHOTOCOMPOSING MACHINE

[75] Inventor: Allan Friedman, Skokie, Ill.

[73] Assignee: Alphatype Corporation, Skokie, Ill.

[22] Filed: Nov. 15, 1974

[21] Appl. No.: 524,260

[52] U.S. Cl. ..... 354/7; 354/13; 354/16

[51] Int. Cl.[2] ..... B41B 15/08

[58] Field of Search ..... 354/16, 15, 14, 13, 354/12, 11, 10, 7, 5; 355/40; 178/15, 17 C

[56] References Cited

UNITED STATES PATENTS

| | | | |
|---|---|---|---|
| 2,475,497 | 7/1949 | Harrold et al. | 354/15 |
| 3,645,180 | 2/1972 | Nakajima et al. | 354/15 |
| 3,670,322 | 6/1972 | Mallebrein | 340/324 A |
| 3,726,193 | 4/1973 | Ishii | 354/11 |

*Primary Examiner*—Joseph W. Hartary

*Attorney, Agent, or Firm*—Gardiner, Sixbey, Bradford, & Carlson

[57] ABSTRACT

The photocomposing machine is adapted to provide over eight thousand characters during operation. Characters are arranged in bands on a plurality of rotating drums, and multiple character keys and alternate keyboard displays are employed to permit selection of a specific character. Basic functional codes such as keyboard identification, type font identification, and shift identification are used to accomplish drum and band selection. A character position code is then used to locate the character in the selected band on the selected drum.

A method of justification for characters such as Japanese characters is employed wherein characters of different size are segregated into two groups. The space available from the characters in the smaller sized group is employed in justification.

10 Claims, 13 Drawing Figures

FIG. 5
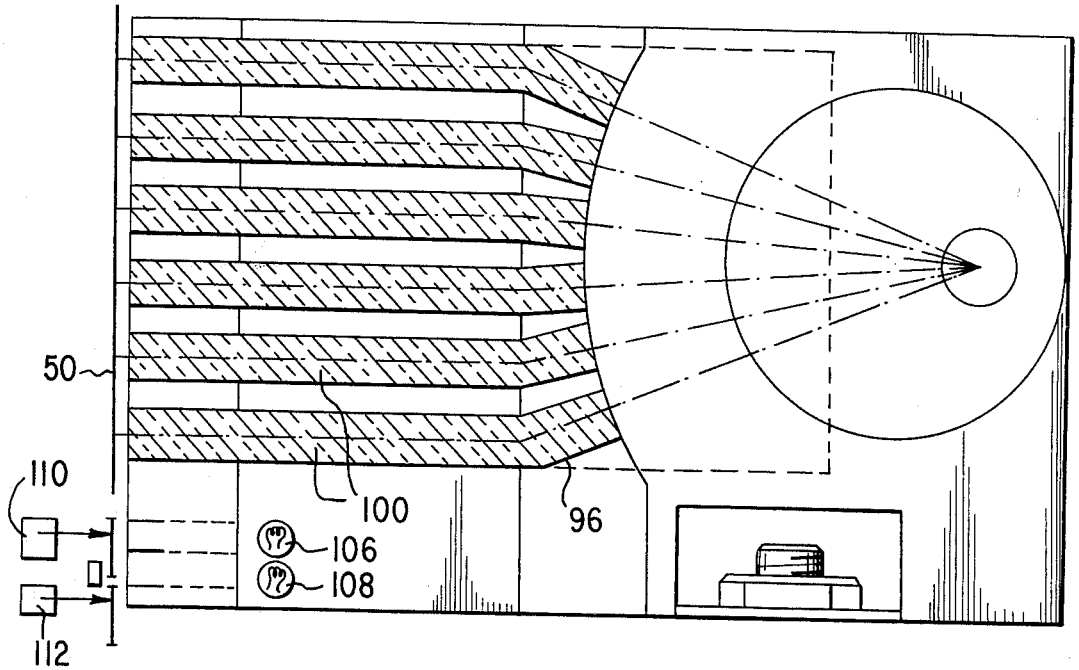
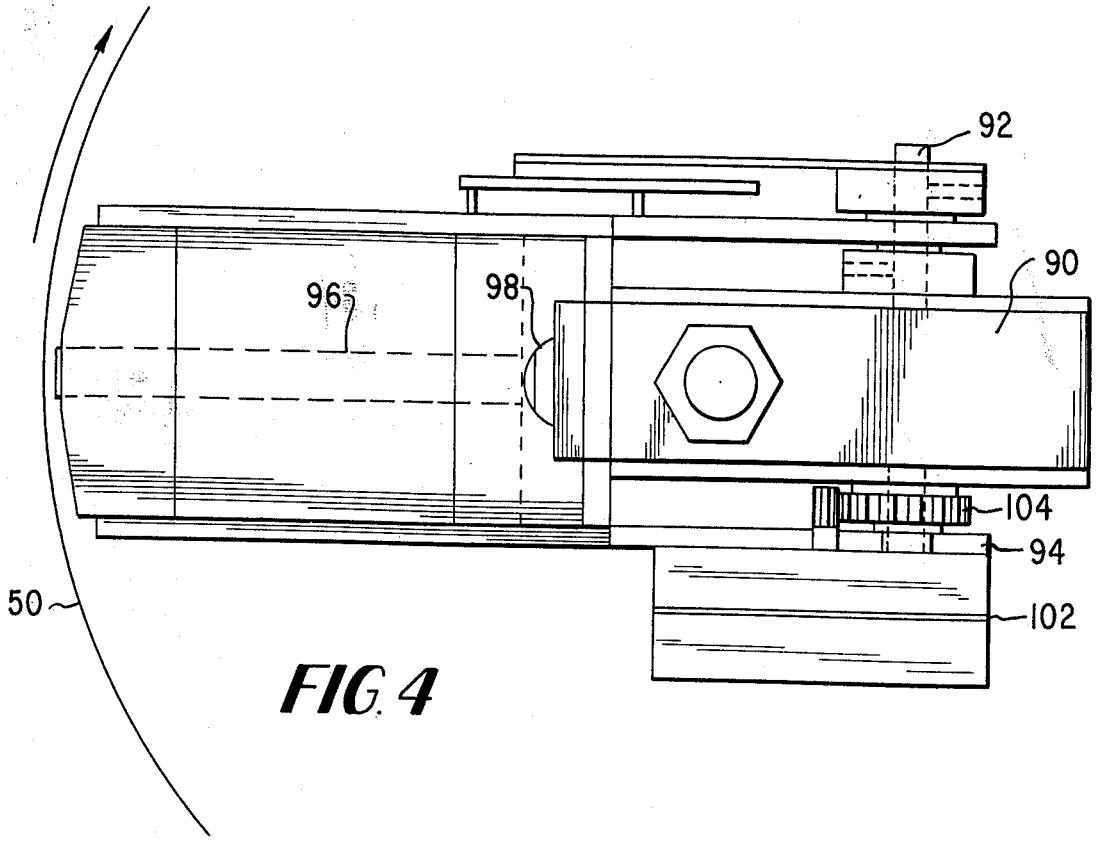
FIG. 4

4 四

JAP. Q = ¼ mm.
= .00984
1 MACHINE UNIT EQUAL
½ Q = .00492

| 12 UNIT EM SYSTEM | | | | | | | | | | | | |
|---|---|---|---|---|---|---|---|---|---|---|---|---|
| SPACE CODE | E/CD | EM UNITS | 14 | 40 | 36 | 28 | 26 | 24 | 20 | 16 | EM | Q. |
| 6/12 | 7/12 | 12 | | | | | | | | | | |
| | 7/9 | 9 | 30 | 27 | 21 | 20 | 18 | 15 | 12 | ¾ EM. | PT. |
| | 7/11 | 8 | 27 | 24 | 19 | 18 | 16 | 14 | 11 | ⅔ EM. | |
| | 7/10 | 7 | 23 | 21 | 16 | 15 | 14 | 12 | 9 | 7/12 EM | |
| 6/13 | 7/13 | 6 | 20 | 18 | 14 | 13 | 12 | 10 | 8 | EN. | |
| 6/14 | 7/14 | 4 | 13 | 12 | 9 | 8 | 8 | 6 | 5 | EM/3 | |
| 6/15 | | 3 | 10 | 9 | 7 | 6 | 6 | 5 | 4 | EM/4 | |

PHOTOCOMPOSING MACHINE

BACKGROUND OF THE INVENTION

Since the development of the photocomposing machine, photocomposing has grown to a position of major importance in the typesetting field. Although complex computerized photocomposing machines have geen developed with the capability to rapidly compose a large number of characters from type faces of diferent designs, such machines are extremely expensive. No photocomposing machine has been developed which employs conventional, relatively inexpensive logic control systems and techniques to facilitate the photocomposing of thousands of characters without requiring the changing of type fonts.

Although photocomposing technology relating to composition in the English language is quite advanced, photocomposition in many foreign languages is still in a very rudimentary stage. For example, even with expensive computerized photocomposing machines, it is still extremely difficult to effectively compose in Japanese. Even a single type font including enough Japanese characters, punctuation, and English characters to provide an adequate range for Japanese composition must include over four thousand characters. For a photocomposing machine to be able to compose characters from just two type fonts with Japanese type faces of different design without a font change, over eight thousand characters are required. These requirements present keyboarding problems and character coding and selection requirements which have not been adequately solved.

To accomplish justification when lines are photocomposed in English, the spaces between words in a line are adjusted. However, with Japanese characters, there are no word spaces to adjust, but the Japanese rules of inhibition, which require that certain characters known as Kanji be followed by other characters known as Kana, make justification desirable. Also, the justification of Japanese type is rendered more difficult by the fact that English words and characters are normally interspersed with Japanese characters in print.

A photocomposing machine having the capability to compose the thousands of characters required for Japanese photocomposition would be readily adaptable for use with the English language, and with smaller alphabets, would have trmendous capabilities.

It is a primary object of the present invention to provide a novel and improved photocomposing machine and method for composing thousands of characters without requiring computerization or type font substitution.

Another object of the present invention is to provide a novel and improved photocomposing machine which is adapted to select characters from a plurality of simultaneously rotating drums; each drum containing many hundreds of characters.

A further object of the present invention is to provide a novel and improved photocomposing machine which is adapted to employ a single functional main keyboard to select characters displayed on both the main keyboard and a plurality of display keyboards.

Another object of the present invention is to provide a novel method of justification for characters of substantially two different width sizes wherein the smaller width characters are sensed and used in justification.

A further object of the present invention is to provide a novel method for automating a photocomposing machine to operate in an automatic end of line mode.

A still further object of this invention is to provide a novel method for justifying characters such as Japanese characters wherein major unit spaces such as those provided by punctuation are first sensed and used for justification and subsequently unit spaces available from characters of smaller width size are sensed and used for justification.

These and other objects of the present invention will become readily apparent from a consideration of the following specification taken in conjunction with the accompanying drawings in which:

FIG. 4 is a plan view of a light gun assembly employed in the photocomposing machine of the present invention;

FIG. 5 is a diagramatic view in side elevation of the light guide assembly used with the light gun of FIG. 4;

Figure 1:
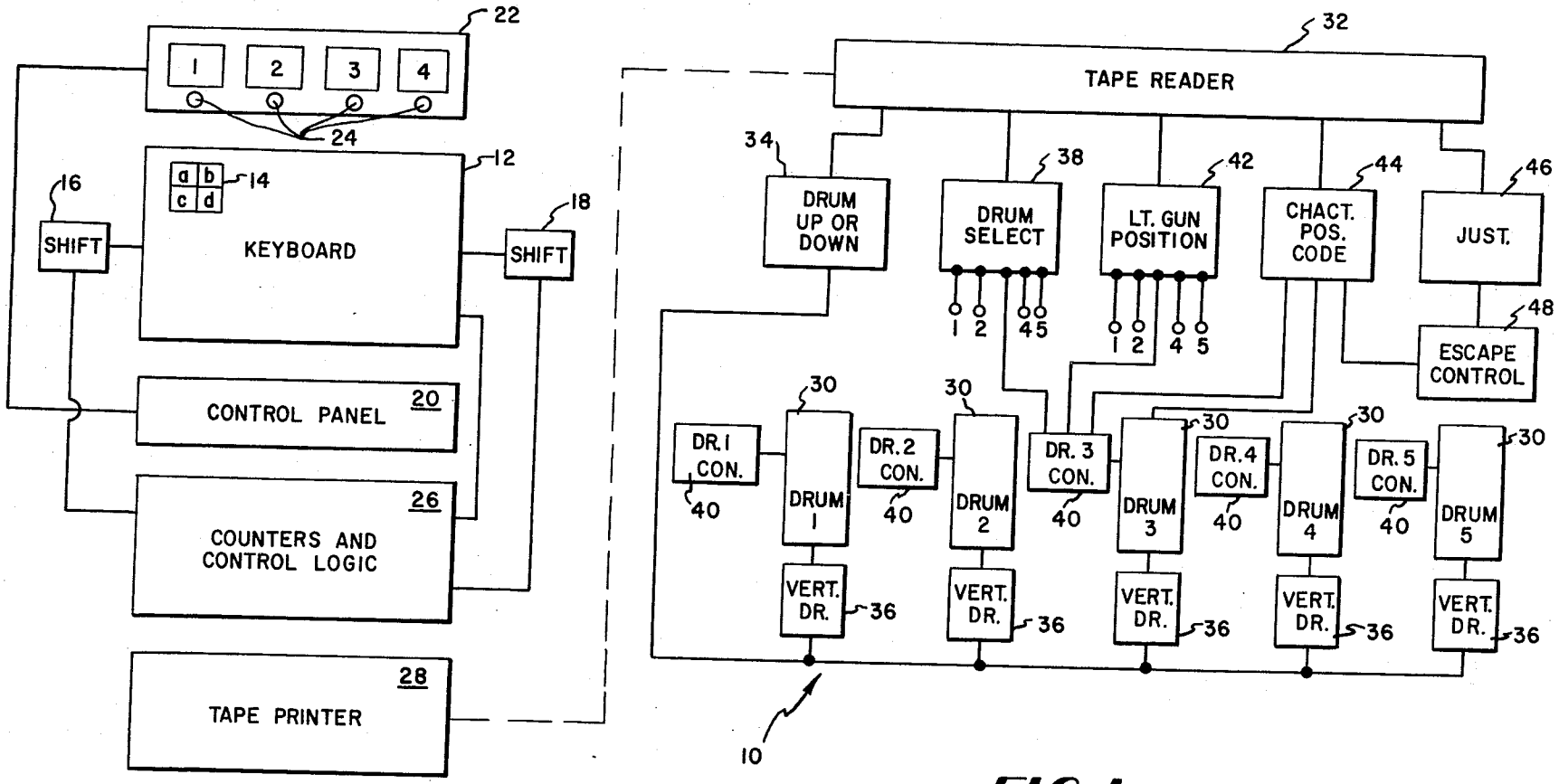
FIG. 1 is a block diagram of the circuit for the photocomposing machine of the present invention.

Referring now to FIG. 1, the photocomposing machine of the present invention is illustrated generally in block form at 10. This photocomposing machine includes a keyboard 12 having a plurality of character selecting keys 14. The depression of one of these character selecting keys by an operator causes character code information to be outputed in a manner to be subsequently described in greater detail. In one embodiment of the present invention, each character key 14 bears the representation of four characters arranged in the sectors *a*, *b*, *c* and *d* as shown in FIG. 1. The selection of the character in any specific sector of the key 14 is controlled by the shift controls 16 and 18 which again provide coded shift information to indicate the shift function which has been chosen. For example, if the key 14 is depressed without activation of either of the shift controls 16 and 18, the character in the *a* sector of the key will be selected. To select the character in the *b* sector of the key, the shift 16 may be activated and the key 14 simultaneously depressed, while to select the character in the *c* sector of the key, the shift 18 is activated while the key 14 is simultaneously depressed. To select a character in the *d* sector of the key, both the shift 16 and 18 are simultaneously activated and the key 14 pressed. The shift 16 may be a hand shift and the shift 18 a foot activated shift to permit a single operator to rapidly control the keyboard 12.

A control panel 20 is provided either as part of the keyboard 12 or as a unit closely associated therewith, and this control panel is used to select the major functional modes of the photocomposing machine 10. By using the control panel 20, the character selection capability of the photocomposing machine can be greatly extended by providing a number of alternate keyboard displays on a display board 22. In FIG. 1, the display board is shown with four keyboard displays which are merely printed sheets bearing a keyboard representation with keys corresponding in position to the keys on the keyboard 12. However, each of the keys on the keyboard displays bears characters which differ from those on the keyboard 12. The control panel 20 is provided with switches to enable the operator to select alternate keyboard 1, 2, 3, or 4, such selection of the alternate keyboard causing a selection indicator 24 under the selected keyboard display to light. This indicates that a display keyboard has been selected in place of the keyboard 12.

Once a keyboard display has been chosen, the operator may press a key on the keyboard 12 which corresponds in position to a desired key on the selected keyboard display. Since the selection of each alternate keyboard causes an identifying code to be provided, a code unique to a character on the selected key in the display keyboard will be produced when the corresponding key on the keyboard 12 is depressed.

The control panel 20 also may be operated to select a desired font from a plurality of fonts and to control character justification in a manner to be subsequently described in greater detail.

The coded outputs from the keyboard 12, the shift controls 16 and 18 and the control panel 20 are provided to a counter and control logic section 26 which then outputs these control codes to a tape printer 28. The codes from the counter and control logic section 26 are printed in sequence on a tape by the tape printer 28, and obviously the tape printer may store information on any type of storage medium or tape commonly used for photocomposing machines such as magnetic tapes, punched tapes, or the like. The coded information placed on the tape by the tape printer 28 will provide all of the information necessary to control character selection from a plurality of rotating drums, which are illustrated in FIG. 1 at 30. Five drums have been shown with the associated control logic therefor, although obviously the number of character drums could be varied.

The code bearing control tape from the tape printer 28 is fed into a tape reader 32 which operates in known manner to output the control code information from the tape. The tape will contain drum vertical position information, drum select information, light gun position information, a character position code, and justification information, all of which has been previously applied to the tape in response to operation of the keyboard 12, the shift controls 16 and 18 and the control panel 20.

The tape reader 32 provides a coded output signal from the tape to a drum up or down control section 34 indicating whether the drums 30 should be moved vertically from a rest position to a second position. If the drums are to be moved from the rest position upwardly to a second position, the drum up or down control section provides a signal to vertical drum drives 36 for all of the drums 30. This causes all of the drums 30 to simultaneously shift vertically between the rest position and a second drum position in a manner to be hereinafter completely described.

The tape reader 32 also provides a drum select code to a drum select section 38, and this drum select section operates to activate a control mechanism 40 for the selected drum. For example, if the drum 3 is selected, the drum select unit 38 will provide an activating signal to the drum 3 control unit 40 which will permit the drum 3 control unit to receive other control signals from the tape reader 32. Since the remaining drums are not activated, they will not be enabled by the drum select unit 38 and therefore will not operate in response to the control code provided by the tape reader 32.

The tape reader 32 provides a light gun position control code from the control tape to a light gun position control unit 42 which then feeds light gun position control signals to the drum control units 40. Since only one drum control unit has been activated from the drum select unit 38, only the light gun for this selected drum will respond to the control signals from the light gun position unit 42. Finally, the character position code is fed by the tape reader 32 to a character position code unit 44 which will store the desired character position code and compare the stored code with an actual character position code received from the selected drum 3. This comparison occurs after the light gun in drum 3 has been positioned and escapement control has been accomplished; both of which occur simultaneously. When the light gun in the selected drum is properly positioned and escapement control has been accomplished, the character position code unit 44 begins comparison of the stored character position from the tape reader with the actual character position provided from the drum 3, and at the instant coincidence occurs, a signal is sent to flash the light gun within drum 3.

Escapement control is achieved in response to a justification code provided by the tape reader 32 to a justification unit 46 which in turn sends escapement control signals to an escapement control unit 48. When a desired escapement has been accomplished, the escapement control unit sends a signal to the character position code unit, and a search now begins for the desired character, if the light gun within the selected drum has already been positioned.

The basic control signals are sequentially printed upon the control tape that is fed to the tape reader 32 and therefore may be read out in a desired control sequence as the tape passes through the tape reader. This is conventional in tape controlled photocomposing machines. For purposes of illustration, the drum select unit 38, the light gun position unit 40 and the character position code unit 44 have been shown in FIG. 1 as connected only to the selected drum control unit 40 for drum 3, but obviously, connections are made to all of the drums and all of the drum control units. It is important for purposes of this invention to note that control signals are provided in response to a coded control tape to cause vertical positioning of the drums, to cause positioning of the light gun within the drums, and to cause selection of a character on a selected drum. A number of logic arrangements may be employed to provide these control functions, and therefore, for purposes of simplicity, this logic has been disclosed in block form. Various very simple recorded codes could be employed to operate the drum up or down unit 34 to cause this unit to provide no drive signal when the drums 30 are to remain in the rest position but to provide a drive signal when the drums are to be moved vertically from the rest position to a second position. A rest position code on the tape directed to a gate or switch network within the drum control unit 34 could cause this switch or gate unit to prevent power from being provided to the vertical drives 36, while a second code on the tape could enable the switch or gate to permit power to be provided by the unit 34 to the vertical drive. Similarly, the drum selection code from the tape reader 38 could be employed to activate one of five coded gates or switches which would provide a selection signal from a power source to the selected drum control unit 40 connected to that specific gate. In this case, it would be possible to employ five gate units each responsive to one of five drum select codes taken from the tape to permit an activate signal to be sent from that specific gate to a selected drum control unit 40 connected thereto.

Each drum control unit 40 could constitute a gate which, when activated from a drum select unit 38, then permits light gun position information and character position information to be used in the control of the selected drum. For example, the light gun position unit 42 could include a comparator unit which receives the desired light gun position code and senses the actual position of the light gun in the selected drum. If this light gun is not in the required position, a signal would then be provided until coincidence between the desired position and the position provided by the tape reader is reached. Once this coincidence occurs, a signal indicating the coincidence would be provided to the character position code unit 44 to indicate that the light gun was in position.

Similarly, the justification control unit 46 which is operating simultaneously with the light gun position control unit 42 can be receiving the justification code from the tape reader 32. This justification code can then be employed to control an escapement control mechanism 48 in a manner known to photocomposing machines. Once the escapement control has operated in accordance with the justification control to escape the photosensitive film used in the photocomposing machine, a signal is provided by the escapement control to the character position code unit 44 indicating that escapement has been completed. Upon receipt of this escapement completion signal and the signal indicating that the light gun is in the proper position, character selection on the selected font may be started. This again may be accomplished by a counter in the character position code unit 44 which is responsive to the actual position of the selected drum 3 and a second counter or storage medium which stores the desired character position from the tape reader 32. Once coincidence between these two counters is reached, a signal is sent from the character position code unit 44 to flash the flash gun within the selected drum.

Figure 2:
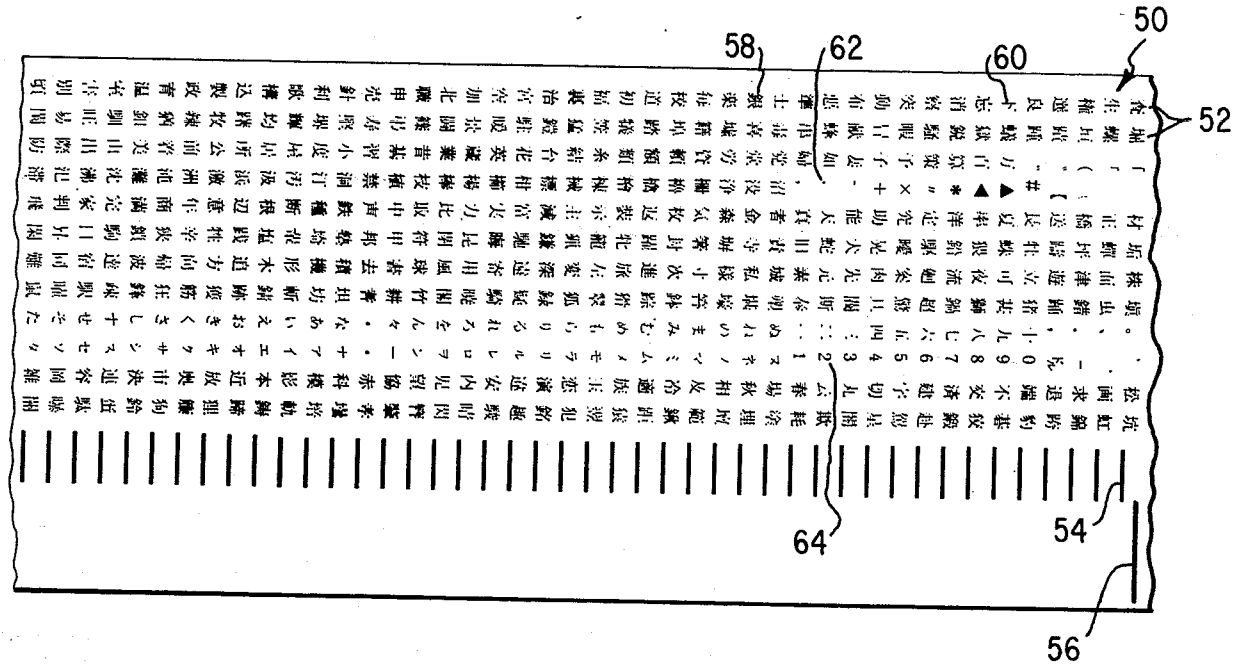
FIG. 2 is an illustration of a portion of a character bearing film cylinder used in the photocomposing machine of the present invention.

A film strip bearing Japanese characters which is adapted for use on one of the drums 30 is partially disclosed in FIG. 2. It will be noted that this strip indicated generally at 50, contains characters arranged in aligned bands 52. There are twelve such bands illustrated on the strip 50 of FIG. 2, and, for purposes of illustration, it may be assumed that each band contains a relatively large number of characters, such as for example one hundred thirty-four characters. Thus, one film strip 50 would contain sixteen hundred and eight characters and the five drums 30 of FIG. 1 would therefore give the machine a character capability of eight thousand forty characters without changing film strips.

Each film strip 50 is an elongated filmstrip formed of film material of the type commonly used in photocomposing machines and bears characters which are adapted to pass light from a light gun. The filmstrip is constructed as a cylinder, and will be seated on a cylinder holder to form the drum 30. The twelve bands 52 of characters are aligned to form aligned columns of twelve characters, and each column is designated by a timing mark 54. The first column of characters on the drum is preceeded by a rezeroing mark 56, so that if the timing marks 54 are counted in a normal manner, a counter will count from one through one hundred and thirty-four and then reach the rezeroing mark 56 which rezeros the counter for a new count. Thus, the timing marks 54 are counted for each revolution of a drum 30.

For purposes of justification to be subsequently considered, it is important to note that the strip of Japanese characters illustrated in FIG. 2 includes characters that are relatively large in size, which are designated Kanji and characters which are smaller in size which are designated Kana. A Kanji is designated at 58 and a Kana is designated at 60. In addition, the strip bears conventional punctuation characters such as the period 62, other conventional characters such as parenthesis and quote symbols, and some English symbols such as the numerals indicated at 64. It is also probable that the strip will include some letters which would permit the composition of English words.

Referring now to FIGS. 3–6, each drum 30 of the photocomposing machine 10 includes a flat, circular base 66 having a peripheral projecting rim 68 extending outwardly adjacent the bottom surface thereof. The peripheral edge of the base is slightly tapered at 70 adjacent the upper surface thereof so that the film cylinder 50 is adapted to slip over the upper peripheral edge of the base and seat against the rim 68. By making the diameter of the film cylinder only slightly larger than the diameter of the upper surface of the base 66, a tight fit between the film and the base will be insured. In fact, the air pressure created when the film cylinder is slipped over the base will cause the lower edges of the cylinder to bow slightly outward, thereby making it easier to mount the film on the base. However, once the film cylinder is mounted and a cap placed upon the upper, open end thereof, air pressure and friction prevent rotation of the film relative to the base and maintain the film securely on the base during rotation of the drum. The film cylinder so mounted with both ends closed has been found to form a drum of considerable strength.

The upper open end of the film cylinder 50 is closed by a cylindrical cap 72 having a body 74 of a diameter which is only slightly less than the diameter of the film cylinder and which is adapted to fit within the upper end of the cylinder. The cap also includes a projecting rim 76 of greater diameter than the body 74 which rests on the upper edge of the film cylinder to completely close the upper end thereof. The cap 72 may be provided with a central aperture 78 which fits over a central shaft 80 projecting through the base 66. The base rotates relative to the shaft 80 which is stationary.

Figure 3:
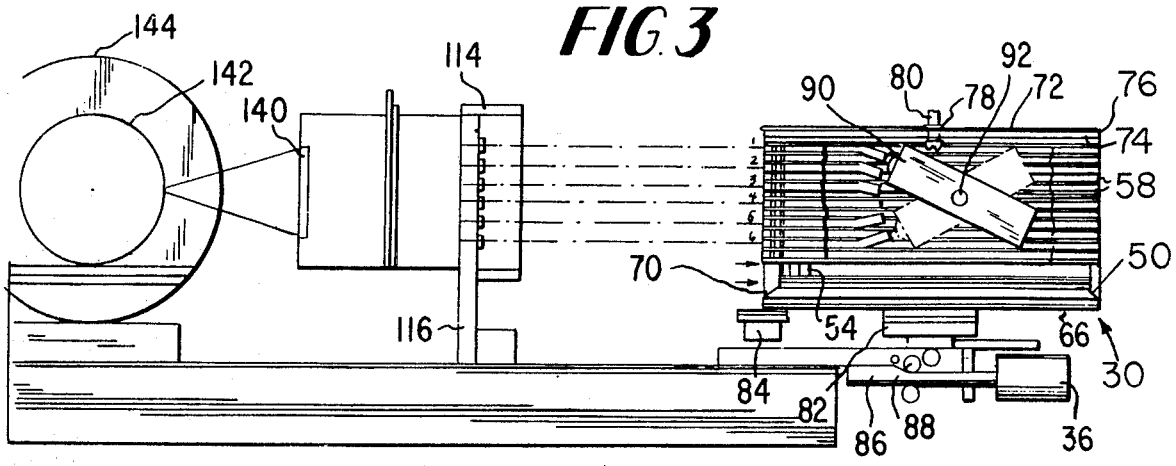
FIG. 3 is a diagramatic view in side elevation of a drum and portions of the optical system for the photocomposing machine of the present invention.

The base 66 and therefore the drum 30 is rotated relative to the shaft 80 by means of a driven pulley 82 which is secured to the bottom of the base and which may be driven by a belt or other suitable means extending from a drive pulley 84 which is driven by a motor, not shown. In FIG. 3, the drum 30 is shown in the rest position, but the drum may be moved vertically from the rest to a second position by the vertical drive 36 described in connection with FIG. 1. For purposes of illustration, this vertical drive 36 might constitute a solenoid which, when activated, draws a cam arm 86 to the right in FIG. 3. This cam arm includes a sloping cam surface which contacts a cam follower 88, causing the cam follower to follow the cam surface and lift the drum 30 upwardly.

Mounted within the drum 30 is a light gun 90 which does not rotate with the drum. However, while the drum rotates about a vertical axis defined by the shaft 80, the light gun may be moved about a horizontal shaft 92. The light gun is mounted upon a stationary frame 94 which also supports a fiber optic assembly 96 for the light gun. This fiber optic assembly extends from adjacent the light transmitting end 98 of the light gun to a point adjacent the cylindrical rotating film 50. As will be noted from FIG. 5, the fiber optic assembly 96 provides six defined light paths 100 to transmit light from the light gun 90 to a point on the film 50.

The light gun 90 is adapted to rotate about a horizontal axis defined by the shaft 92 to six positions, thereby selecting one of the six vertically spaced light paths 100 provided by the fiber optic unit 96. The light gun is stepped to a selected position by means of a stepping motor 102 which drives a gearing mechanism 104 to control the position of the light gun. The motor 102 steps in response to signals provided by the light gun position unit 42 of FIG. 1.

Light sources 106 and 108 are mounted upon suitable stationary mounting means within the film 50 to project light through the timing marks 54 and the zero mark 56. The light source 106 projects light through the timing marks 54 to a suitable photocell pickup device 110 while the light source 108 projects light through the zero mark 56 to a suitable photocell pickup device 112. The photocell pickup device 110 is connected in known manner to a counter for counting the timing marks, while the photocell pickup device 112 is connected to a zeroing means for this counter.

Although the term "drum" has been used to describe the character bearing assemblies for the photocomposing machine, this is not intended to limit the invention to the cylindrical structure shown. Instead, the term applies to all equivalents, such as a non-cylindrical endless film strip arrangement which might be driven around the light gun 90 and moved vertically between two positions.

Figure 6:
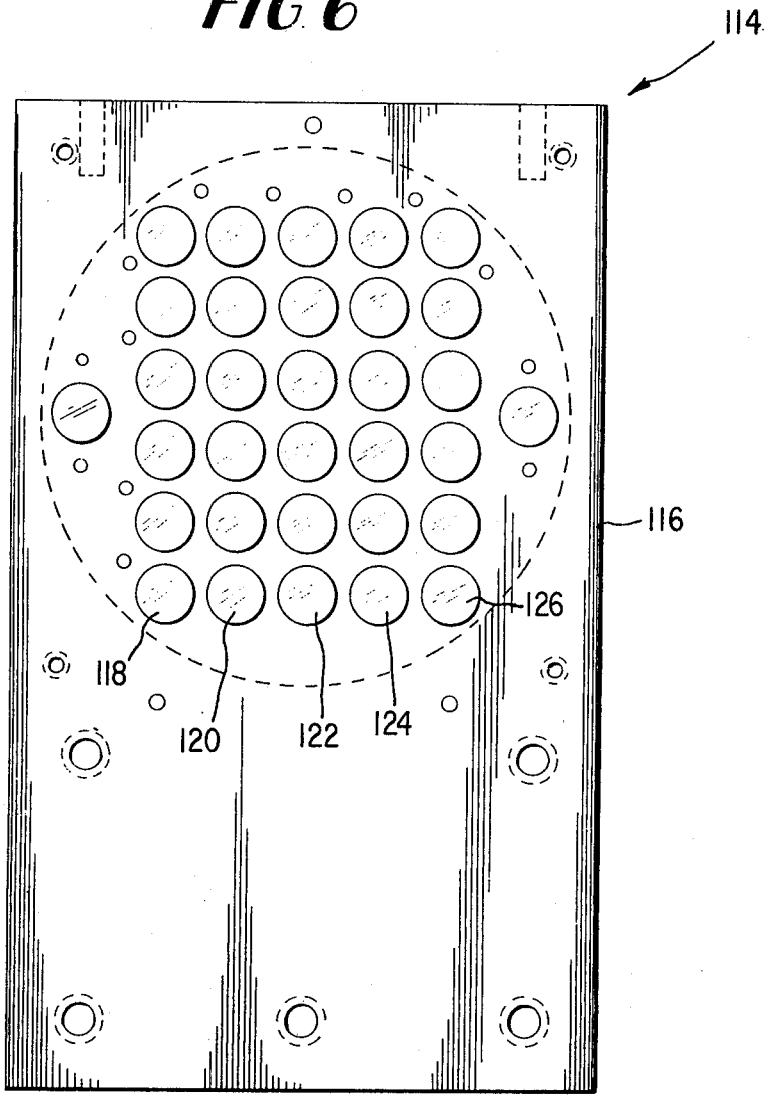
FIG. 6 is a view in front elevation of the small lens assembly of FIG. 3.
Figure 7:
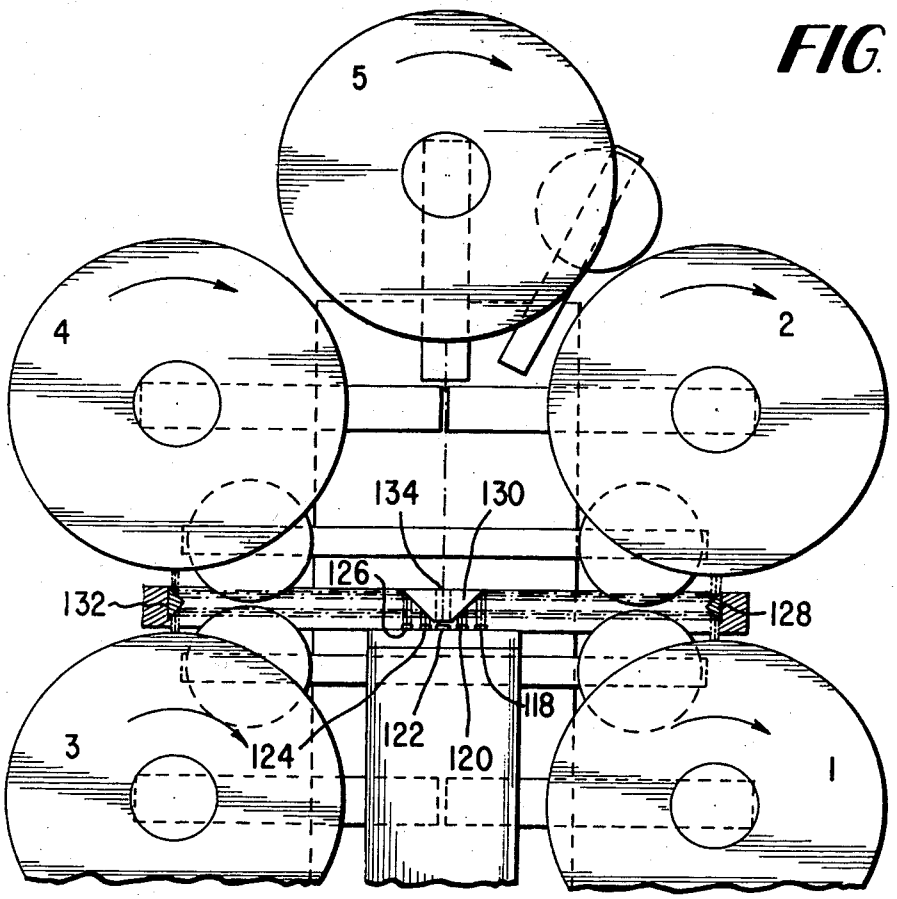
FIG. 7 is an optical diagram illustrating the optical unit for the photocomposing machine of the present invention.

Upon a consideration of FIGS. 3, 6 and 7, the operation of the optical system employed with the photocomposing machine of the present invention will become readily apparent. First, as has been previously described, the light gun 90 may be stepped to six different positions causing light to be flashed to one of six selected points on the rotating film cylinder 50. Thus, in the rest position of the drum 30, the light gun may be positioned to illuminate characters in any one of six selected bands on the film cylinder. This is illustrated by the bands numbered 1, 2, 3, 4, 5 and 6 in FIG. 3. Then, if the vertical drive unit 36 is activated to move the drum 30 from the rest to the second vertical position, the bands on the film cylinder intermediate the bands numbered 1, 2, 3, 4, 5 and 6 are brought into registration with the six light paths 100 provided by the fiber optic unit 96. Thus, by selectively positioning the light gun 90 and moving the drum 30 to one of two possible vertical positions, characters in all twelve bands on the film cylinder may be selectively illuminated. Obviously, the cam surface on the cam arm 86 is dimensioned to move the light drum 30 for a distance equal to the distance between the center line for two adjacent bands of characters on the film 50.

Now, briefly reviewing the operation of the control system of the photocomposing machine as illustrated by FIG. 1, all drums have been positioned vertically, the drum select unit 38 causes activation of the control 40 for drum 3, and the light gun positioning unit 42 positions the light gun 90 within the drum 3 to one of six positions. The character position code from the tape reader is stored in a comparator unit, such as a first counter, and when both light gun positioning and escapement control have been completed, a gate within the character position code unit 44 is activated so that the timing marks 54 can be counted. A counter for the timing marks 54 is suitably reset in a manner to be subsequently described when the reset line 56 is sensed, and the timing marks 54 are then counted until a second counter receiving pulses from the photocell 110 is in coincidence with the stored character position code provided by the tape reader 32. The instant that this coincidence is reached, the flash gun 90 in the selected drum is flashed causing light to pass through a selected light path in the fiber optic unit 96 and through the character on the film 50 which is at this instant positioned to receive light from this light path. Since the operation of the flash gun is instantaneous, the illuminated character will appear to be stationary to the optical system for the photocomposing machine, although in actuality the selected drum is rotating. This illuminated character will be projected to appear at the principal axis of a small lens contained in a lens system 114.

The construction of the small lens unit 114 will become apparent from a consideration of FIGS. 3 and 6 wherein it will be noted that the lens unit is mounted by a mount 116 to receive projected characters from the five rotating drums 30. There are five vertical columns of small lenses secured to the mount with six lenses in each column. Thus, there is a vertical column of small lenses to receive characters from each of the five drums illustrated in FIG. 7. A vertical column 118 of small lenses receives characters projected from drum 2, a lens column 120 receives characters from the drum 1, a lens column 122 receives characters from the drum 5, a lens column 124 receives characters from the drum 3, and a lens column 126 receives characters from the drum 4. The six small lenses in each of the vertical lens columns 118–126 are spaced vertically to correspond with the six vertical positions which the light paths 100 of the fiber optic unit 94 illuminate. The vertical spacing of the lenses in each column is such that an image illuminated on the drum for this column appears at the principal axis of the corresponding one of the small lenses in the column. This optical arrangement may better be understood by referring to the optical diagram of FIG. 7 wherein the relative arrangement of the drums 1, 2, 3, 4 and 5 is shown. A character projected from one of the six vertical points on drum 1 is reflected by an angled reflector 128 to a central reflector 130 which then reflects the projected character into one of the lenses in the lens column 120. Similarly, a projection from the drum 2 is reflected by the angled reflector 128 to the central reflector 130 which then directs the projection into one of the lenses in the column 118. The opposed drums 3 and 4 provide projections along similar optical paths, and it will be noted that projected characters from the drum 3 are reflected by an angled reflector 132 onto a reflective surface of the central reflector 130 which then directs the projection into a lens in the column 124. A projected character from the drum 4 is reflected by the angled reflector 132 along a path to the reflective surface of the central reflector 130 and is then directed into one of the lenses in the column 126.

Figure 8:
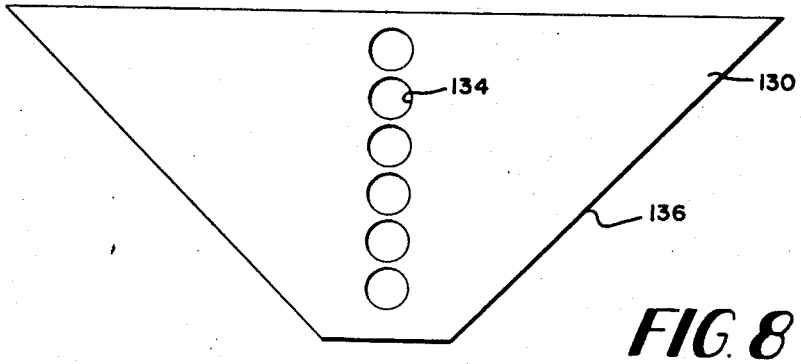
FIG. 8 is a view in front elevation of a main reflector shown in the optical diagram of FIG. 7.

Characters projected from the drum 5 are not reflected, but instead pass directly through one of six apertures forming a column 134 in the central reflector 130. As will be noted from FIG. 8, these apertures extend completely through the central reflector and are formed in alignment with the individual lenses in the column 122. The side surfaces 136 and 138 of the central reflector are reflective as previously described.

Referring back now to FIG. 3, the projected image appearing at the principal axis of one of the small lenses in the lens group 114 is then directed onto a large optical gathering lens 140, and in accordance with known optical princiapls, the image appearing at the principal axis of the small lens will appear at the principal axis of the gathering lens. Thus, any image appearing on the principal axis of any of the small lenses in the lens group 114 will be projected along the principal axis of the gathering lens 140 which is focused on a rotating drum 142. A photosensitive film is mounted upon the drum 142 in a manner common to photocomposing machines so that the images projected from the lens 140 will be received by the photosensitive film. The drum includes a rim 144 having gear teeth or other suitable means to permit escapement of the drum in known manner by the escapement control 48. Thus escapement of the film mounted on the drum 142 may be mechanically accomplished by a number of escapement mechanisms well known to the art.

Figure 9:
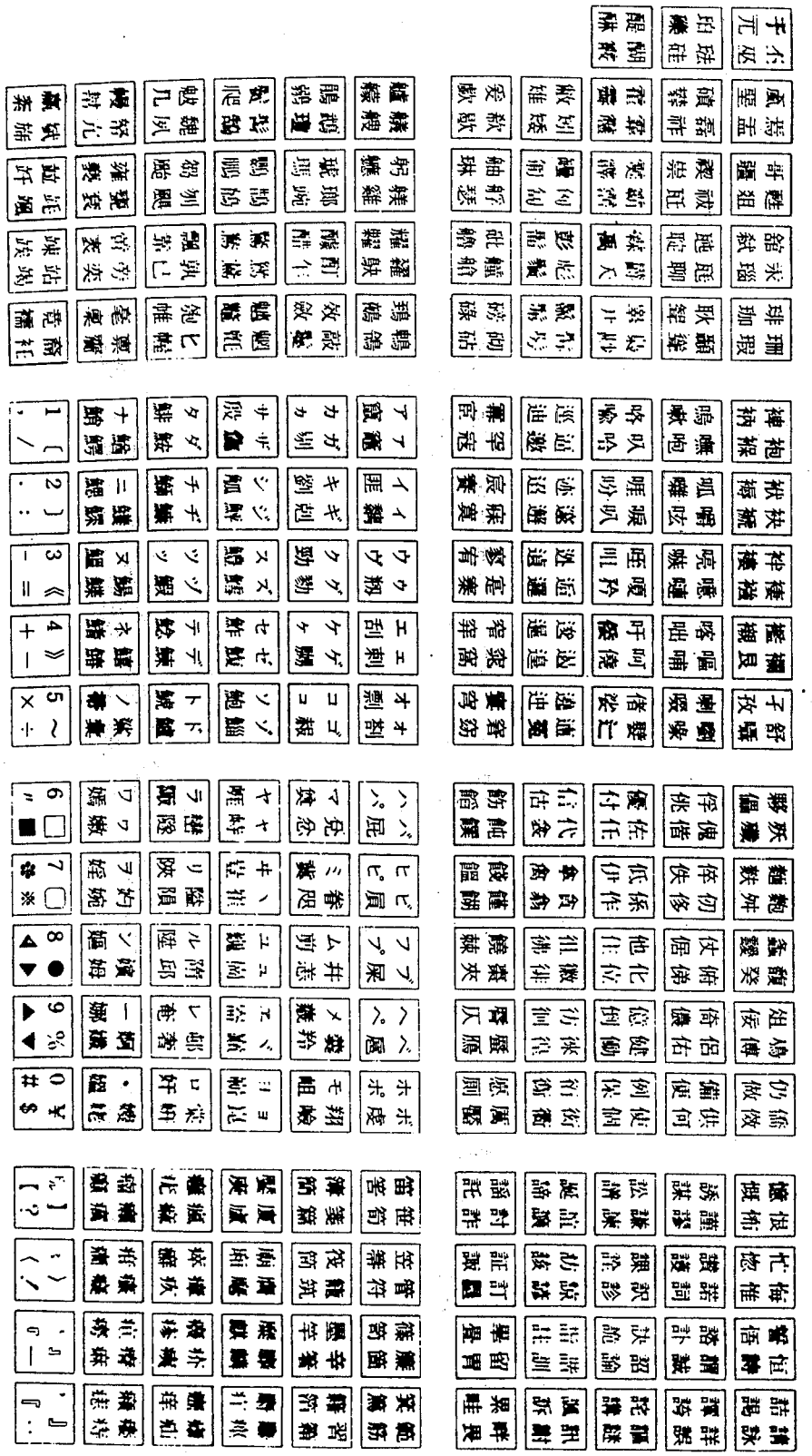
FIG. 9 is a diagram of the character keyboard for the photocomposing machine of the present invention.

Now that the drum controls and optical systems for the photocomposing machine 10 have been considered, additional consideration should be given to the keyboard and control section which results in printing of the control tape by the tape printer 28. FIG. 9 provides a showing of one of the alternate keyboard displays which is mounted upon the keyboard display unit 22, and also provides an indication of the layout for the character keys 14 appearing on the main keyboard 12.

Figure 10:
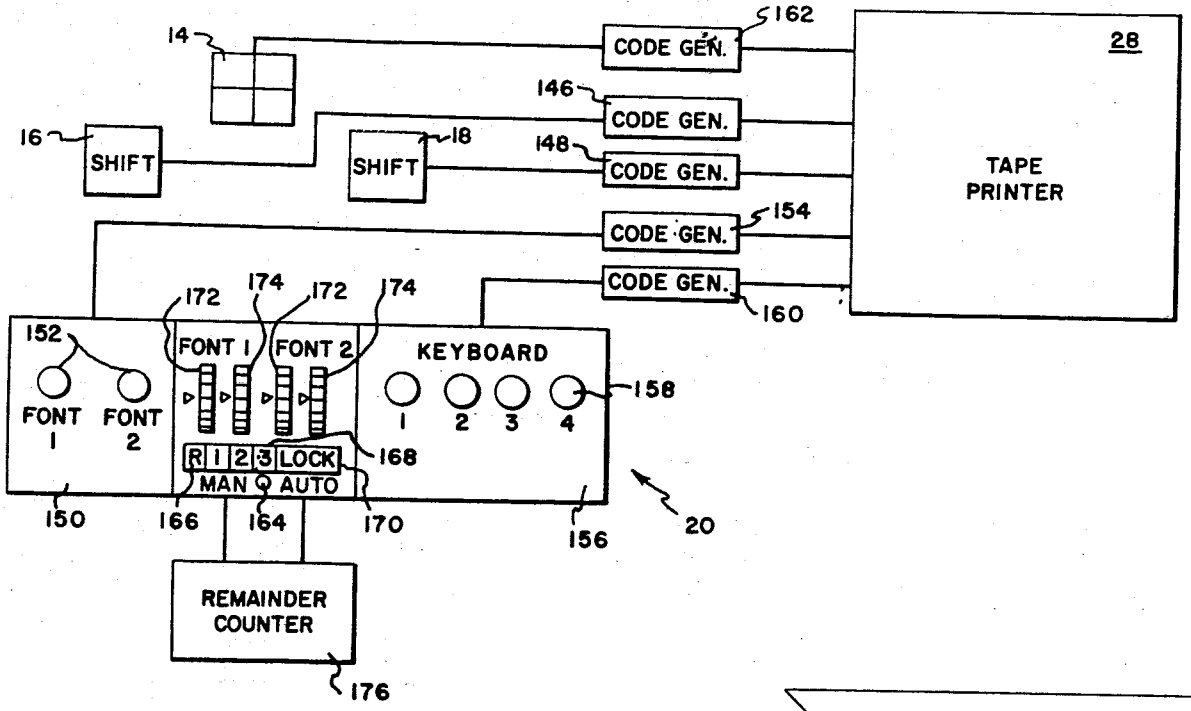
FIG. 10 is a block diagram of the control unit of FIG. 1.

Referring now to FIG. 10, the major selection codes on the control tape provided by the tape printer 28 result from operation of control units on the control panel 20. Assume for purposes of illustration, that the five possible keyboards shown in FIG. 1 are being employed and that two separate type fonts of different characters are utilized. Assume also that one type font appears on drums 1, 2 and half of drum 5 while the second type font appears on drums 3, 4 and the remaining half of drum 5. If each drum contains two keyboards, with the exception of drum 5, then, when the drums are in the rest position, a keyboard in a first set of six bands is selected while when the drums are in the second, raised vertical position, a keyboard in a second set of six bands is selected. Once this positioning is recognized, it will be seen that simple codes printed on the control tape to indicate which keyboard is in operation, which font is in operation, and which shift function has been selected will provide an initial modifier code which results in the ultimate selection of one of the five drums and the specific band on the drum in which the desired character occurs. This may be simply accomplished as illustrated in FIG. 10 by connecting the shift control 16 to a code generator 146 and the shift control 18 to a code generator 148. These code generators may be any known code generator operative to provide one code indication when the associated shift control is activated and a second indication when the associated shift control is not activated. Thus, the code generators 146 and 148 are adapted to provide four modifier codes to the tape printer 28. Namely, a first code is provided when either of the shift control units are activated, a second code is provided when the shift control 16 is activated, a third code is provided when the shift control 18 is activated, and a fourth code is provided when both the shift controls 16 and 18 are activated.

Similarly, the control borad 20 includes a font selection section 150 including font selection controls 152. These font selection controls then operate a code generator 154 which provides one code indication if font 1 is selected and a second code indication if font 2 is selected.

Finally, a keyboard selection section 156 is provided on the control panel 20 which has four control buttons 158 to select one of the desired alternate keyboards. These buttons operate a code generator 160 which provides a code when none of the alternate keyboards are selected and also a specific identifying code for each of the four alternate keyboards. All of the codes from the code generators 146, 148, 154 and 160 are fed to the tape printer 28 to print modifier codes which wil accomplish drum selection and the selection of a band of characters on a specific drum. The character code which locates the specific character in the band is then initiated by the character key 14 through a character code generator 162 which causes the tape printer to print a character position code indicative of the specific character key depressed. Code generators adapted to provide specific codes in response to the depression of character keys and also adapted to provide codes relative to other control functions of the machine are well known to the photocomposing art.

The control unit 20 also includes a section which controls the justification function of the photocomposing machine 10. This section includes a manual and automatic control switch 164, a reverse button 166, a character indicator 168 and a lock indicator 170. Also, for each character font, a first selector 172 is provided to set in the number of characters per line measure which will be employed in composing a line of characters, and a second selector 174 for each font is provided to preset the type size in units per line. The selectors 172 and 174 may constitute thumb wheel selectors, and operate to preset a remainder counter 176 which will count down in response to the operation of the keyboard for the photocomposing machine in a manner known to the art. When three characters remain in a line to be composed, a character counter will activate the indicator 168 to provide a remainder indication. Thus, for a twenty character line, when the seventeenth character has been selected, the eighteenth character will cause the three indicator to light, the eighteenth character will cause the two indicator to light, and the nineteenth character will cause the one indicator to light. If the line is subsequently overrun to an extent beyond justification capabilities of the machine, the lock indicator 170 will light. To then remove portions of the line, the reverse mechanism 176 may be activated to reverse the tape printer and erase characters from the tape.

Considering now in detail the justification functions which may be accomplished with the photocomposing machine 10, it must first be recognized that justification of characters, such as Japanese characters, is entirely different from the justification commonly employed in known photocomposing machines for use with the English language. Justification of lines composed in the English language, in the broad sense, generally connotates the adjustment of spaces between words to accomplish the desirable justified line. In the Japanese language, however, characters are employed, and there are no word spaced between characters. Theoretically, each Japanese character may be considered to be formed on a block equal to the size of the blocks bearing all other Japanese characters, and Japanese photocomposing can be accomplished by putting equal numbers of such blocks in each line. Actually, however, the photocomposing of Japanese characters is not this simple as will be noted with reference to FIG. 11.

Figure 11:
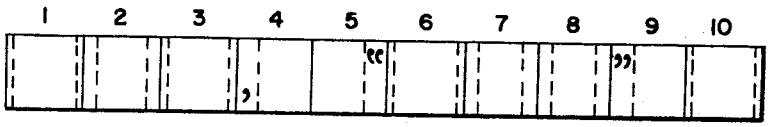
FIG. 11 is a diagram illustrating a line of characters.

In FIG. 11, a diagram of a ten character line is depicted wherein, in accordance with theoretical Japanese typesetting principals, an equal block or space is provided for each character. However, the actual size of the character is indicated by the broken lines in each character space. Thus it may be assumed that in block one, a Kanji is to be printed, in block two a Kana, in block three a Kanji, in block four a comma, in block five a quote, in block six a Kanji, in block seven a Kana, in block eight a Kana, in block nine a quote and in block ten a Kanji. In the Japanese language there are Rules of Inhibition which require that certain Kanji be followed directly by a Kana. Therefore, if the Kanji in block ten is to be followed by a Kana, something must be done to rearrange the characters in the line of FIG. 11. This would be further complicated if a punctuation mark such as a period is to follow the Kana required subsequent to the Kanji in block ten.

The novel method of the present invention for justifying composed lines of a language consisting of characters, punctuation, and possibly English letters may best be understood with reference to FIGS. 10, 11, 12 and 13. This method, for purposes of illustration, will be described with relation to a line of Japanese characters, although it should be understood that this method is applicable with any language requiring the use of characters to form words or expressions.

To justify the line illustrated in FIG. 11, assume that the characters forming this line are to be taken from font 1 and that the thumb wheel 172 has been set to provide ten characters in the line. Next, the thumb wheel 174 for font 1 must be set to provide the type size for the characters being composed. Actually, this character unit size can be in accordance with any applicable scale, and for Japanese use, this scale would be machine units. The chart in FIG. 13 is exemplary of a unit scale which may be employed in Japanese photocomposing, where the machine will respond to units designated machine units for justification.

Figures 12, 13:
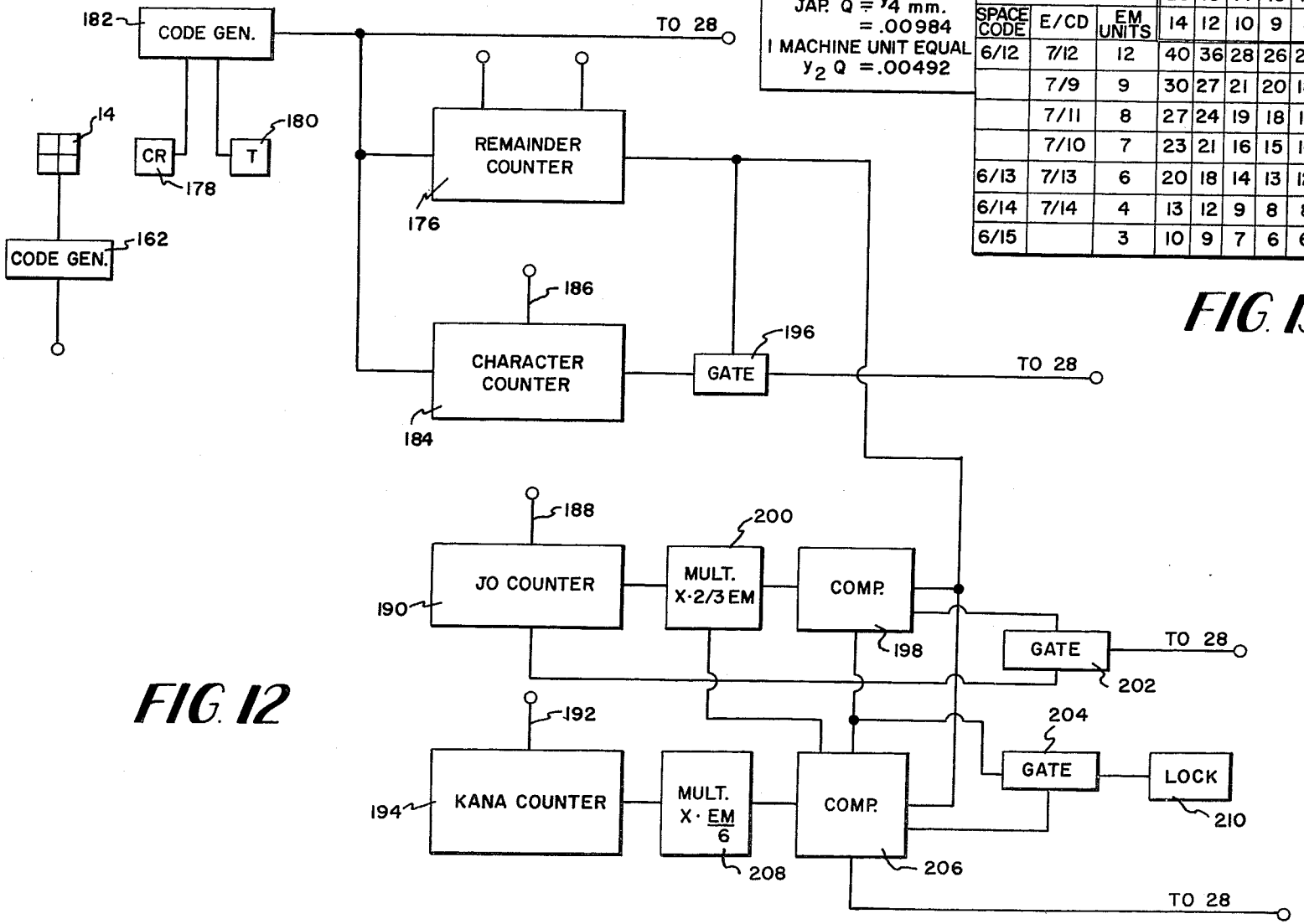
FIG. 12 is a block diagram of the justification circuit for the photocomposing machine of the present invention.
FIG. 13 shows a unit width chart for use with Japanese characters.

Referring now to FIG. 12, two keys from the keyboard 12 are illustrated which initiate or start justification. These keys are the carriage return key 178 and the tab key 180. When either of these keys is depressed, a code generator 182 associated with these keys sends a code to the tape printer 28 indicating that justification is to begin. Also, depression of the carriage return or tab keys causes a signal to be sent to clear the remainder counter 176 and permit the number of machine units present in the next line to be preset into the remainder counter. The number of machine units in the next line is provided from the preset thumb wheels 172 and 174 which, as will be recalled, designated the number of characters per line and the type size per character. These thumb wheels may control code units of a known type which store mathematical code indicative of the total number of machine units in a line. Such units would receive the values preset by the thumb wheels 172 and 174 and accomplish a simple multiplication function to determine the total number of units in the desired line. This total number of units would be stored as a code, for example a binary code, and then fed to reset the remainder counter 176 when the remainder counter is cleared by activation of either the carriage return or tab keys.

When the remainer counter 176 is cleared, a character counter 184 is also simultaneously cleared or zeroed. This zeroing of the character counter should occur each time either the carriage return or tab key is depressed, and can be made responsive to a signal occurring in response to the depression of these keys.

Once the remainder counter has been cleared and reset and the character counter has been zeroed, keyboarding of the next line of characters occurs. As the characters are struck on the keys 14 of the keyboard 12, the character counter 184 counts the number of characters minus one and the remainder counter 176 counts down in machine units. This type of operation is conventional in known photocomposing machines wherein the number of characters in a line and the type size of the characters are preset. If, in accordance with the diagram of FIG. 11, ten characters to a line have been set into the machine by the thumb wheel 172, then when the character counter indicates that the seventh character has been struck, the three indication on the indicator 168 will light. When the eighth character is struck, the two indication will light, and when the ninth character is struck the one indication will light. This informs the operator of the numbers left in the line.

The diagram of the composed line illustrated in FIG. 1 shows that a comma is present in block four and that quotation marks are present in blocks five and nine. Since each one of these blocks is equal to a determinable number of machine units in width, it may then be ascertained how many machine units are not being used in blocks four, five, and nine. For example, in cases where punctuation is inserted in the line, it may be determined that two thirds of each block bearing punctuation is not employed. The keys 14 of the photocomposing machine relating to punctuation may provide a code to indicate not only that a punctuation mark is being struck, but also to indicate the portion of the block which is being unused. Thus, for the comma in block four and the quotation mark in block nine, an indication would be given that the right portion of the block is the unused portion, while for the quotation mark in block five, it would be indicated that the left portion of the block is the unused portion. Each time a key 14 is depressed, an input is fed at 186 into the character counter 184 to cause the character counter to count down one count after the first character in the line has been struck. If the character happens to be the punctuation marks in blocks four, five, and nine of FIG. 11, this information is provided at the input 188 of a JO counter 190 causing this counter to count up one for each of such characters. This may be easily accomplished by providing these characters with a unique code which, when sensed, will provide a count to the JO counter. Also, this unique code when printed on tape will indicate whether the unused space is on the right or left of the character.

Finally, in accordance with the present invention, the Kana in blocks 2, 7, and 8 of FIG. 11 can be provided with a unique identifying code which, when sensed, causes a count to be provided to the input 192 of a Kana counter 194. The number of units which may be taken from each block bearing a Kana can be determined, as illustrated in FIG. 11 and, as an example, let it be assumed that two units may be taken from each Kana block. Using this as a measure, two units may be acquired between blocks one and two, two units may be acquired between blocks two and three, and four units may be acquired between blocks seven and eight. This is due to the fact that Kana appear both in blocks seven and eight, thereby providing two units from each Kana block.

Once the line of FIG. 11 has been keyboarded and ten characters have been printed upon the control tape, if the operator decides to press the carriage return and go to the next line, there has been no overrun. The remainder counter and the character counter will show no overrun, and a gate 196 will then be activated to permit the printer to print a positive justification code on the control tape. Referring to FIG. 11, however, it will be noted that block 10 contains a Kanji. Assuming under the Japanese Rules of Inhibition that the operator recognizes that this Kanji must be followed by a Kana, the operator will now strike the Kana putting eleven characters in the line and causing the remainder counter to go below zero. The gate 196 will now not be activated, and instead the negative units from the remainder counter will be provided to a comparator 198. This comparator compares the number of overrun machine units with the number of machine units made available in the line by the punctuation marks in blocks four, five and nine. For example, referring to the chart of FIG. 13, in a ten character line with the assumption that two thirds of the block is available in blocks four, five and nine, there would be fourteen units available in each of these blocks.

The output from the JO counter 190 is fed to a suitable multiplier 200 which multiplies the number of blocks registered by the JO counter times the available units in each block, and this total number is fed to the comparator 198. The number of available units from the punctuation blocks is then compared with the number of overrun units from the remainder counter 176, and if there are a sufficient number of units available to accommodate the overrun, the comparator activates a gate 202. This gate permits a coded output from the JO counter 190 to pass to the tape printer 28 indicating the justification may be accomplished with the units from the JO counter.

Assume now that the operator is required to strike characters which cause the remainder counter to overrun beyond the capabilities of the extra units provided by the JO counter 190. If this occurs, the comparator 198 will not activate the gate 202, but will instead provide a signal to a lock up gate 204. This also activates a second comparator 206 which receives the total number of units available from the multiplier 200 and also receives the total number of units available from the Kana in the line from a second multiplier 208. The multiplier 208 operates in the same manner as the multiplier 200. Upon receipt of the number of Kana in the line from the Kana counter 194, the multiplier computes the total number of units provided by these Kana. Thus the total number of available Kana units is fed to the comparator 206 and in combination with the available units indicated by the multiplier 200, are compared with the overrun units from the remainder counter 176. If there are enough combined units from the multiplier 200 and the multiplier 208 to accommodate the overrun, the comparator 206 permits a signal to be sent to the tape printer 28 causing the tape printer to print a justification code indicating that justification will occur. If the combined available units indicated by the multipliers 200 and 208 will not accommodate the overrun indicated by the remainder counter 176, the comparator 206 provides a negative indication signal to the gate 204, and this negative indication signal, combined with the presence of the negative indication signal from the comparator 198, activates a lock unit 210. The lock unit upon activation, causes the lock indicator 170 to light, and the operator can then press the reverse control 166 to cause the tape in the tape printer to reverse and erase the overrun from the line.

Briefly reviewing the operation of the photocomposing machine 10 to accomplish justification in accordance with the method of the present invention, a line overrun first causes a comparison to occur between the number or overrun units and the number of JO counter units available. If these JO units, such as units provided by punctuation, are sufficient to accommodate the overrun, than a justification code is placed upon the control tape for later use in escapement control, and no use is made of additional units available from the Kana in the line. However, if the additional units indicated by the JO counter are not sufficient to accommodate the overrun, then these units are combined with the units available from the Kana, and if these combined available units are sufficient to accommodate the overrun, the tap is then coded to indicate that justification is to occur. In some instances, there may be no count registered in the JO counter, and then, if the units available from the Kana in the line are sufficient, the overrun will be accommodated entirely by the Kana.

Upon consideration of the photocomposing machine and method of the present invention it will become readily apparent that the machine is well adapted to perform various alternate or ancillary photocomposing methods. For example it may be easily operated in the automatic mode by activating control button 164 to permit an operator to continually keyboard characters without operating the carriage return key. In this automatic mode, when the one light on the indicator 168 goes out indicating that the preset line is filled, a sensing mechanism may then be activated to sense the next character struck by the operator. If the coding of the next character causes the sensing mechanism to sense that the character is a required Kana or a punctuation mark with available units to the right thereof, the machine will print this next character causing the line to overrun and the justification unit of FIG. 12 to operate in the manner previously described. After this overrun character is printed and the next character sensed by the machine is indicated not to be a punctuation mark or a Kana, the carriage return is automatically activated.

If, in the automatic mode, the preset number of characters has been keyboarded into the line and the machine senses that the next character is not a Kana or a punctuation mark with available units to the right thereof, then the carriage return is automatically activated and the next line keyboarded. This automatic mode allows the operator to constantly type characters without considering either the Rules of Inhibition of justification.

English letters or characters on the machine should be especially coded to indicate that English letters are being recorded, and this code will be sensed to prevent the character counter 186 from recording a character as long as the line of English letters is unbroken. Thus, a number of English letters forming a word will be recorded by the character counter as only one character, but a break between the English words, such as a space or Japanese character cause the operation of the character counter.

Finally, many modifications may be made in the character position code unit 44 of FIG. 1 to control selection of characters on the drums 30. For example, when a keyboard such as the keyboard 12 contains more character keys than are included in one band of characters on a drum, it will be necessary to incorporate the extra characters in a second band. This may be accomplished by providing special codes which will cause the counter which counts the timing marks 54 to reset to some desired count other than zero when the reset mark 56 is sensed. By adjusting this reset value, various arrangements of characters on the drum may be accomplished.

I claim:

1. A photocomposing machine comprising a plurality of charater drum means, each including a rotatable character drum bearing characters to be optically projected, each said character drum means also including drum traversing drive means to move said rotatable character drum in a direction substantially parallel to the axis of rotation thereof between a first and a second drum position, said characters being arranged in a plurality of substantially parallel equally spaced bands extending circumferentially around each of said character drums the distance between said first and second drum positions being equal to the distance between the centers of two adjacent bands of characters and light projection means mounted within each of said rotating character drums for projecting characters along an optical path outwardly from the character drum, each such light projection means including light gun means mounted against rotation with said character drum and light gun positioning means to selectively move the light gun means to one of a plurality of light projection points, said light gun means being operative at each of said light projection points to illuminate characters in a different band of characters of said character drum.

2. The photocomposing machine in claim 1 wherein said light positioning means is operative to move said light gun means about an axis which is substantially perpendicular to the axis of rotation of said character drum.

3. The photocomposing means of claim 1 wherein said light gun means is operative at each light projection point to selectively illuminate characters in one of two adjacent character bands on said character drum, said light gun means illuminating characters in one band when the character drum is in the first drum position and characters in a second band when the character drum is in the second drum position.

4. The photocomposing machine of claim 3 wherein the number of said light projection points is one half the number of character bands on said character drum.

5. The photocomposing machine of claim 4 which includes at least three character drum means.

6. The photocomposing machine of claim 1 which includes optical means for transmitting projected characters from said character drum means, a small lens assembly having a line of spaced lenses for each character drum means, each of said lenses being positioned to receive a projected character at the principal axis of such lens, a gathering lens means for receiving at the principal axis thereof the projected characters from the small lens system, said gathering lens means operating to focus said characters on a photosensitive receiving medium at a common point of focus.

7. The photocomposing machine of claim 6 wherein said optical means includes a reflector means positioned between said small lens assembly and said character drum means to direct projected characters to said small lens assembly, said reflector means including a line of apertures extending therethrough and positioned to directly transmit projected characters from one of said character drum means to one line of spaced lenses in said small lens assembly and at least one reflective surface for directing projected characters from the remaining character drum means to the remaining lines of spaced lenses in said small lens assembly.

8. The photocomposing machine of claim 1 which includes storage means to store drum traverse drive commands, light gun position commands, drum selection commands and character position commands, drum traverse control means connected to receive said drum traverse drive commands from said storage means and operative in response thereto to cause the drum traverse drive means to move said character drums to either said first or second drum positions, drum select means to receive drum selection commands from said storage means and operative in response thereto to permit control signals to control the operation of a selected character drum means, light gun position control means connected to receive said light gun commands from said storage means and operative in response thereto to provide position control signals to the light gun positioning means for the character drum means selected by said drum select means, said light gun positioning means operating in response to said position control signals to move the light gun means to a designated light projection point, and character position control means connected to receive character position commands from said storage means and to activate the light gun means in the selected character drum means to illuminate a character designated by said character position command.

9. A photocomposing machine comprising a plurality of character drum means, each including a rotatable character drum bearing characters to be optically projected, each character drum means also including drum traversing drive means to move said rotatable character drum in a direction substantially parallel to the axis of rotation thereof between a first and a second drum position, said characters being arranged in a plurality of substantially parallel, equally spaced bands extending circumferentially around each of said character drums, the distance between said first and second drum positions being equal to the distance between the centers of two adjacent bands of characters and light projection means for projecting characters along an optical path outwardly from each rotatable character drum, said light projecting means including light means mounted against rotation within each said rotating character drum and operative at a plurality of spaced projection points to illuminate characters in a band of characters on a rotatable character drum, the number of light projection points being less than the number of character bands on the rotatable character drum, and light control means to cause the light means to illuminate characters adjacent a selected light projection point, said light means illuminating at a selected light projection point characters in a first band when the character drum is in the first drum position and characters in a second band when the character drum is in the second drum position.

10. The photocomposing machine of claim 9 wherein said light means within each said rotatable character drum is formed by a single movable flash lamp, said flash lamp being positioned by said light control means to illuminate a selected light projection point.

* * * * *